US006308869B1

(12) United States Patent
Simpson

(10) Patent No.: US 6,308,869 B1
(45) Date of Patent: Oct. 30, 2001

(54) KEG AND KEG FITTING FOR DISPENSING LIQUIDS UNDER PRESSURE

(75) Inventor: Kenneth Leonard Simpson, Shrewsbury (GB)

(73) Assignee: Spears Limited, Shropshire (GB)

( * ) Notice: Subject to any disclaimer, the term of this patent is extended or adjusted under 35 U.S.C. 154(b) by 0 days.

(21) Appl. No.: 09/485,446

(22) PCT Filed: Aug. 4, 1998

(86) PCT No.: PCT/GB98/02331

§ 371 Date: Feb. 10, 2000

§ 102(e) Date: Feb. 10, 2000

(87) PCT Pub. No.: WO99/07632

PCT Pub. Date: Feb. 18, 1999

(30) Foreign Application Priority Data

Aug. 11, 1997 (GB) ..... 9716910

(51) Int. Cl.[7] ..... B65D 83/00
(52) U.S. Cl. ..... 222/400.7; 222/542
(58) Field of Search ..... 222/400.7, 397, 222/542; 137/212

(56) References Cited

U.S. PATENT DOCUMENTS

| | | | | |
|---|---|---|---|---|
| 3,776,260 | * | 12/1973 | Ruddick | 222/400.7 |
| 5,713,496 | * | 2/1998 | Ipsen | 222/400.7 |
| 5,833,098 | * | 11/1998 | Gomi | 222/400.7 |

FOREIGN PATENT DOCUMENTS

| | | |
|---|---|---|
| 0025 682 A | 3/1981 | (EP) . |
| 0262762 A1 | 4/1988 | (EP) . |
| 0512 152 A | 11/1992 | (EP) . |
| 0734999 A1 | 10/1996 | (EP) . |
| 2 267 252 A | 11/1975 | (FR) . |
| 1281573 | 7/1972 | (GB) . |
| 215917 A | 3/1984 | (GB) . |
| 7 704 708 A | 10/1978 | (NL) . |

* cited by examiner

*Primary Examiner*—Joseph A. Kaufman
(74) *Attorney, Agent, or Firm*—Marshall, Gerstein & Borun

(57) ABSTRACT

A keg for dispensing beer or other liquids under pressure is provided with a neckless spear arrangement. The spear comprises a body intended to be welded permanently to the keg with all parts of the spear assembled through that body. When so assembled escape is prevented so that in the event of interference by any unqualified person there is no risk of the spear being ejected as a missile.

8 Claims, 13 Drawing Sheets

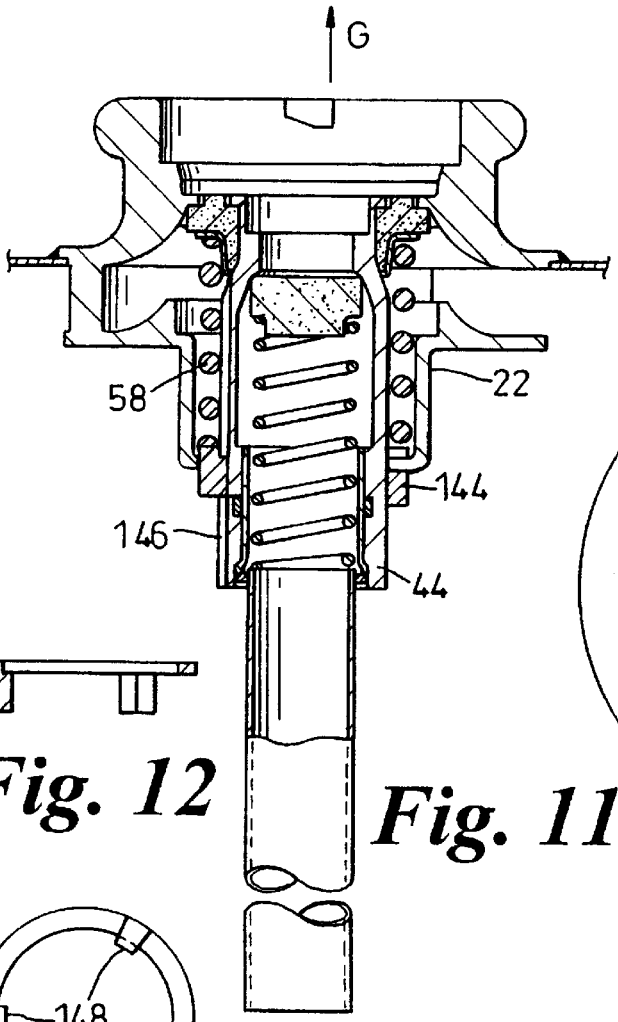
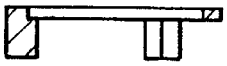
Fig. 12
Fig. 11
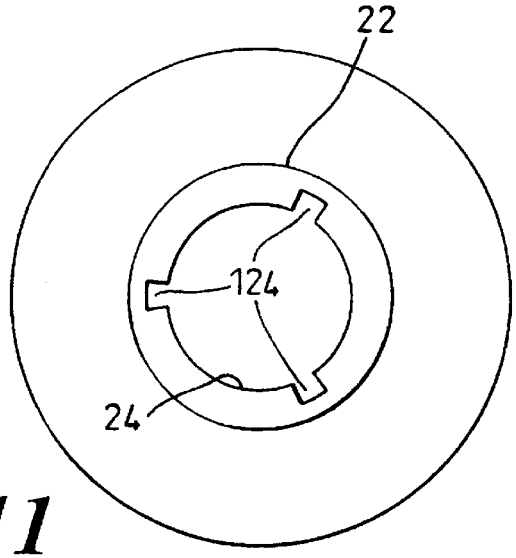
Fig. 15
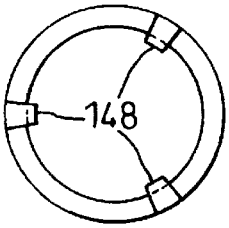
Fig. 13
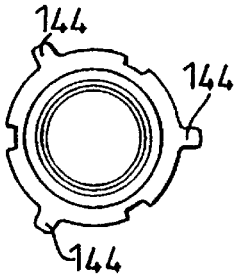
Fig. 14
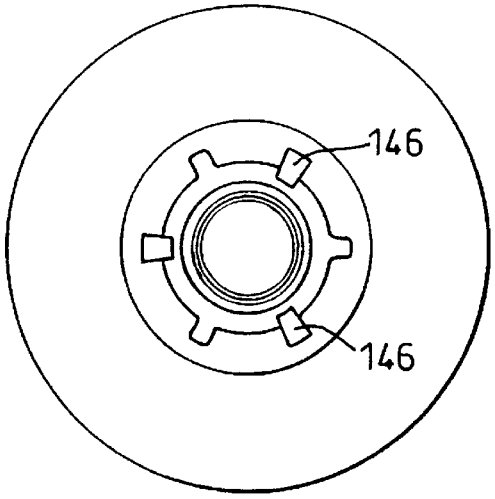
Fig. 16

KEG AND KEG FITTING FOR DISPENSING LIQUIDS UNDER PRESSURE

This invention relates to kegs used in the pressurised dispensation of beer and other liquids.

Conventionally a keg has a neck, that is to say a tubular extension often from one end face of a generally cylindrical keg body, and a spear which is assembled into that neck. The neck may carry a female screw-thread and the spear have a complementary male thread, or alternatively the spear may be held in the neck by a circlip (RTM). The spear includes a tube which extends inside the keg generally from the neck to a point close to the opposite end face of the keg.

When liquid is dispensed, two valves in the spear open, one to admit the pressurising gas and the other to allow discharge of the liquid. When the keg is to be filled, it is usually inverted and the same valves may be opened to different extents in this case to allow liquid to be admitted through one of the valves and gas to be discharged through the other of the valves.

The problem in the well known and conventional arrangements is that if any attempt is made to remove the spear whilst the keg is pressurised, it may end up being blown out when it is a potentially dangerous missile.

The object of the present invention is primarily to avoid the mentioned danger and secondarily to provide for rapid filling of a keg so that in, for example a brewery filling plant, a smaller number of filling stations may be needed for unit output, whilst at the same time being compatible with conventional filling apparatus.

According to the invention considered broadly, a keg for storing and dispensing pressurised liquid comprises a spear permanently fixed in the wall of the keg without a surrounding neck.

This broadest aspect of the invention provides the increase in storage capacity or reduction in space because of the absence of neck and because the spear is permanently fixed it cannot form a missile because it cannot be detached. However, the spear requires moving parts in order to be shifted from a storage mode to a dispensing mode or a filling mode and the provision of such parts in a manner in which they cannot form a missile if interfered with is a subject of a further part of this invention.

According to this further part of the invention a spear primarily for a neckless keg comprises a body apt to be permanently secured to the keg, an axial flow passage formed in a spear tube, a poppet valve controlling flow through the tube, a radially outwardly located flow passage in or defined by said body, a second valve for controlling flow through said outwardly located passage, and means for preventing movement of said tube in the direction outwards of the keg when the body is so secured.

The spear (using this term for the complete assembly) or the body of the spear may be secured to the wall of the keg by welding.

The word "primarily" is used hereinbefore because of the possibility that the invention be could utilised in a necked keg although not originally devised therefore.

Further features of the invention will be apparent from the following description and are defined in the accompanying claims.

Turning now to the accompanying drawings, various embodiments of the invention are described;

FIG. 11 is a view similar to FIG. 1, but on a reduced scale, showing a modified spear;

FIG. 12–16 are scrap views of parts shown in FIG. 11 showing arrangement of the parts, is FIG. 12 is an elevation of the parts shown in FIG. 13;

Figure 22:
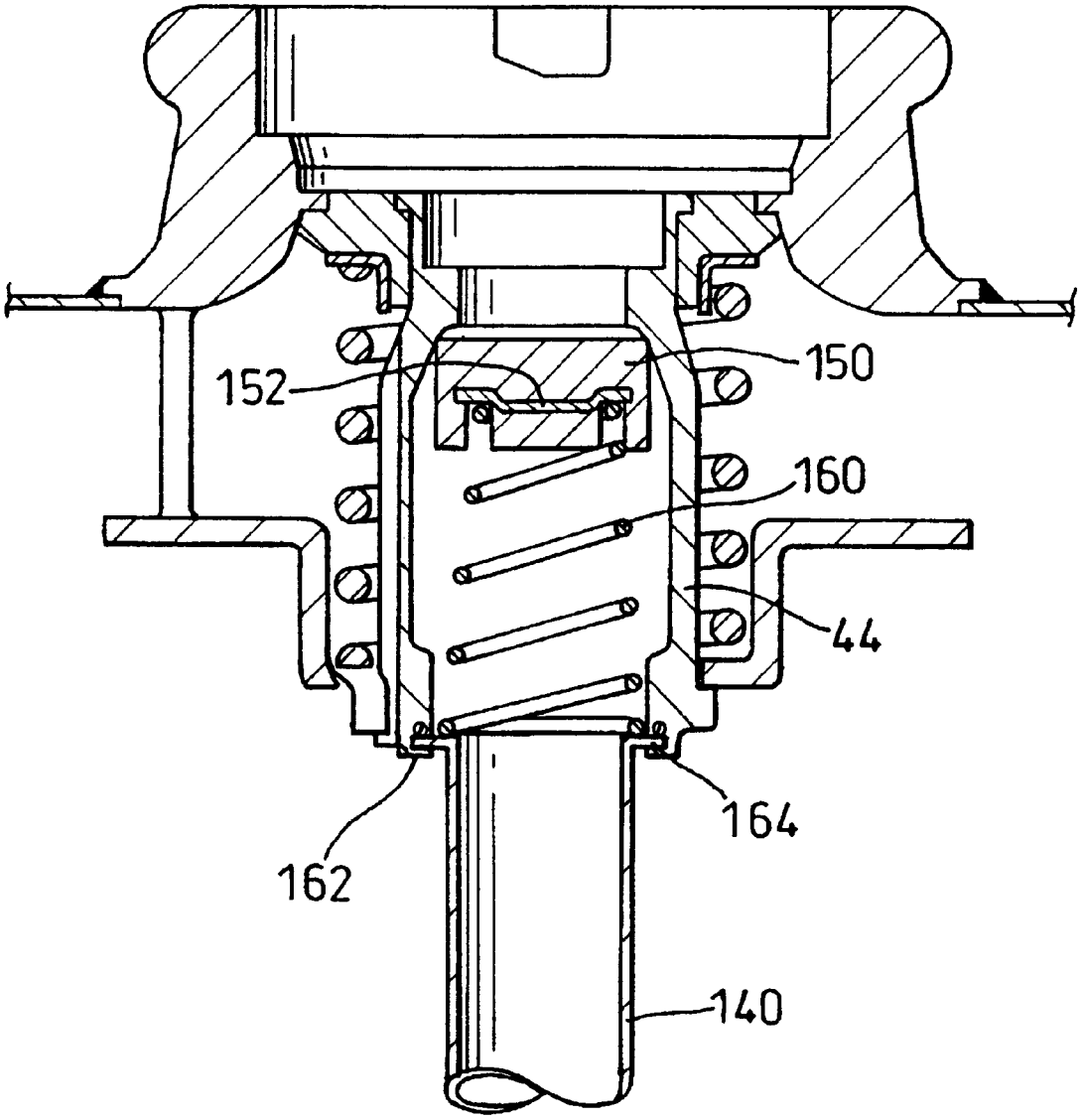

Finally FIG. 22 shows yet another embodiment.

Turning first to the embodiment shown in FIGS. 1–10, the end wall of the keg is illustrated by the referenced numeral 10 and the spear is fixed to the keg for example by a ring of welding 12 on the exterior. Alternatively the weld could be on the interior.

The spear assembly is now discussed with reference to FIG. 4 and is seen to comprise a body 20 including a cup shaped part 22 with aperture 24 in its base. The body is provided with a plurality of generally radial flow paths 26 and preferably the cup 22 is connected to the remainder of the body by a small number for example three bars 28 so that the whole of the periphery at that point between the bars provides outlet apertures from the flow passages 26.

Figure 1:
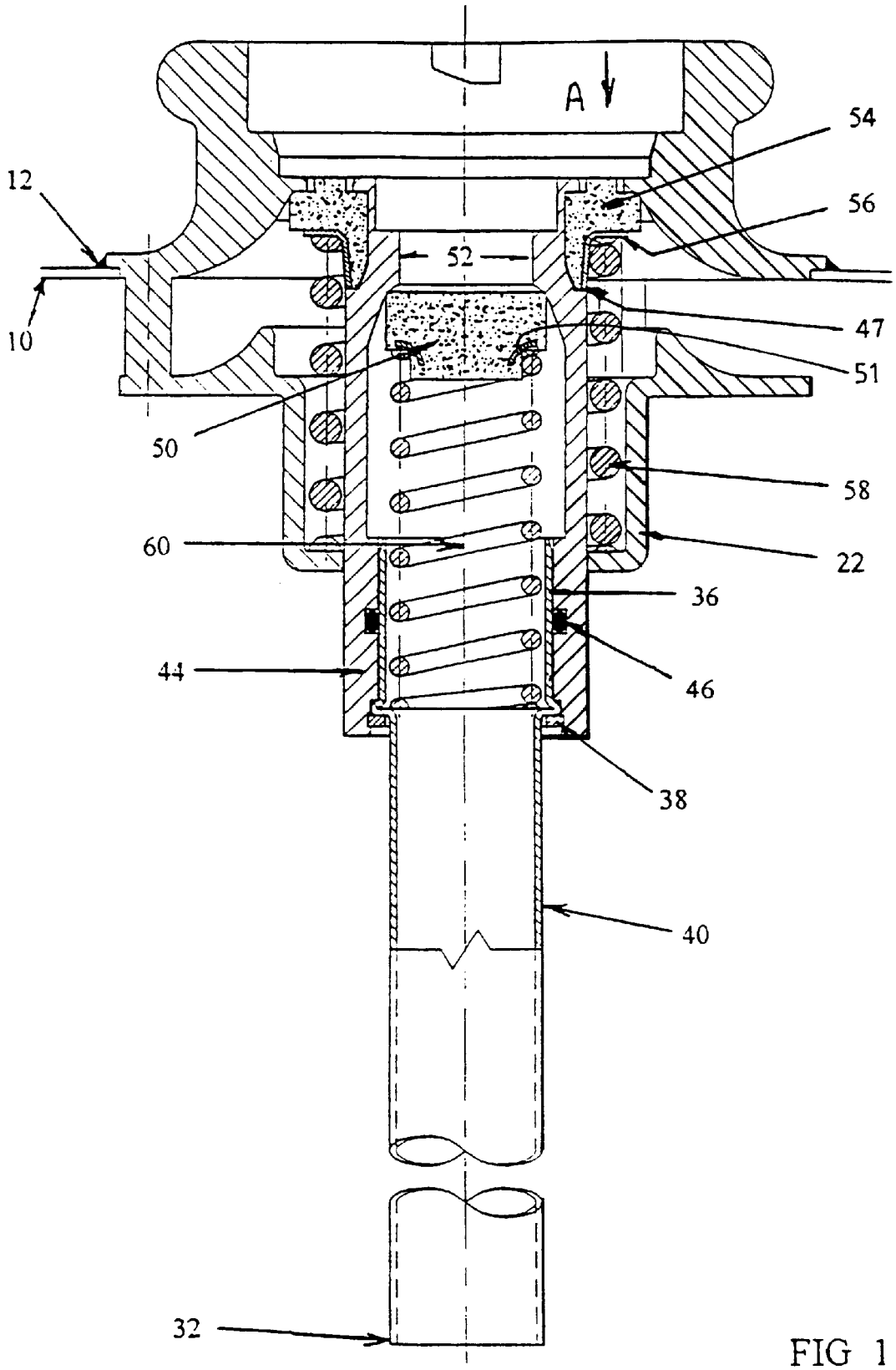
FIG. 1 illustrates a first embodiment in the closed or storage position.
Figure 2:
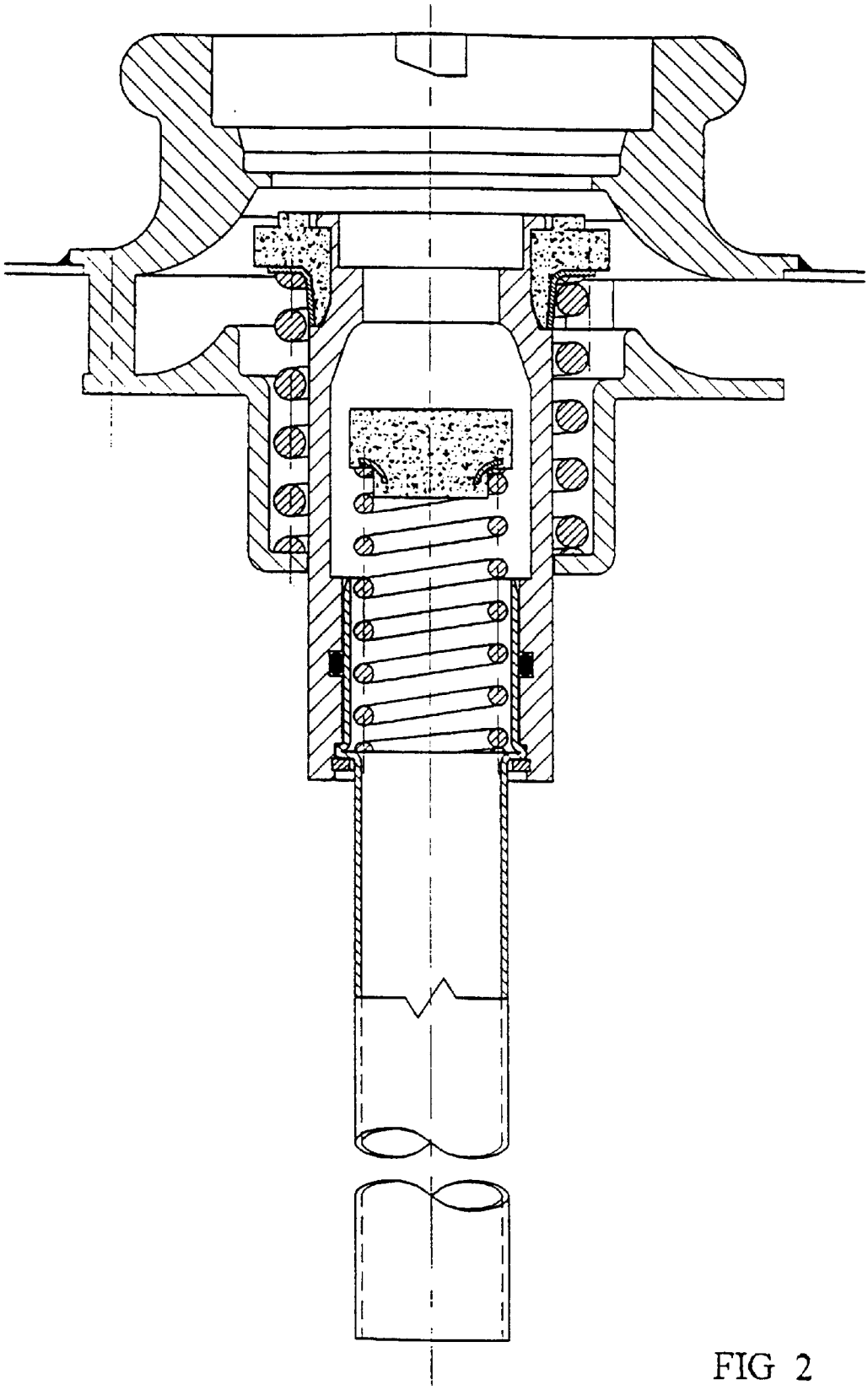
FIG. 2 shows the same in a dispensing position.
Figure 3:
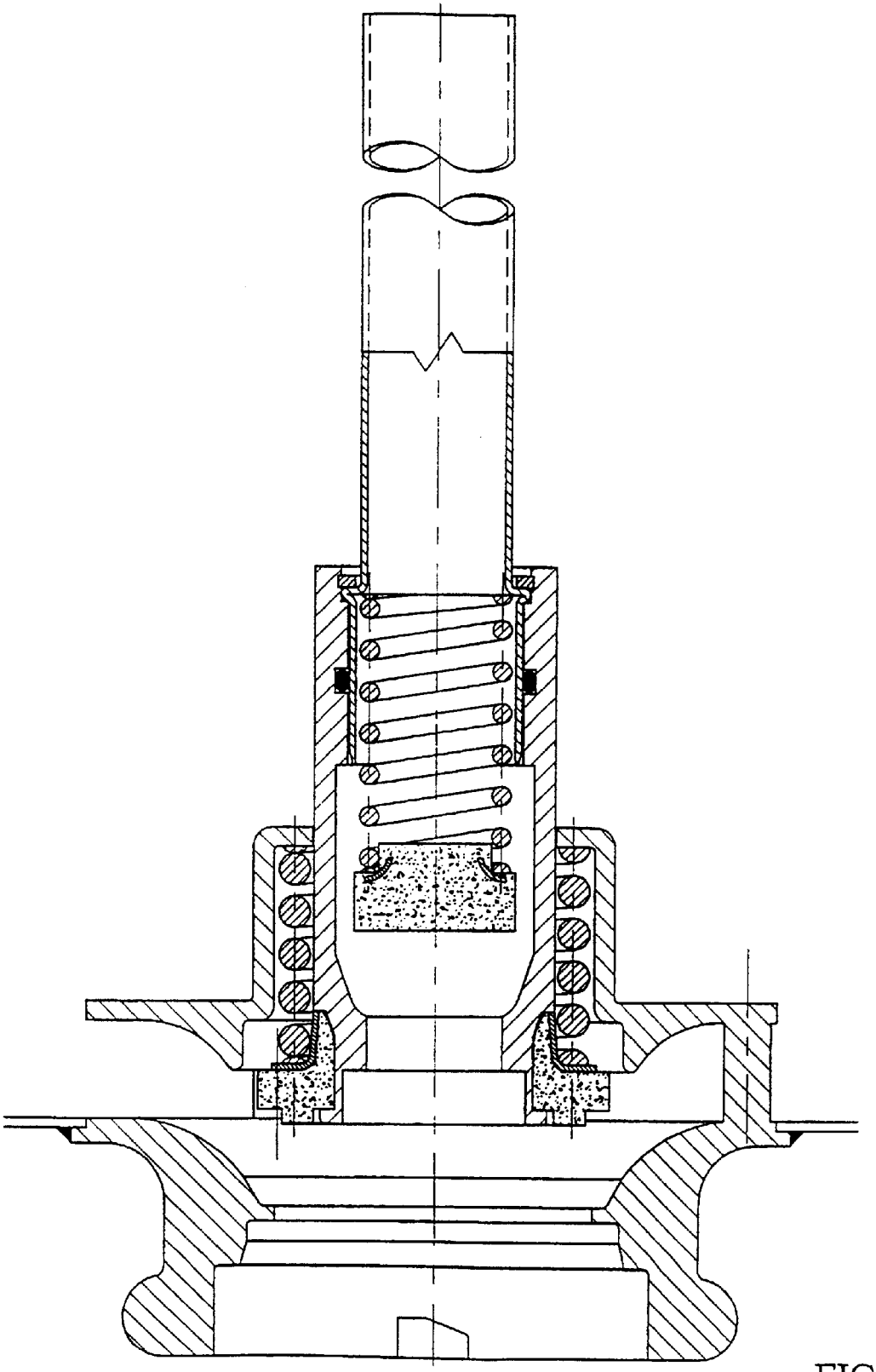
FIG. 3 shows the same inverted when in use in keg filling; and in an a different degree of opening

Spear tube 30 is of a length such that when assembled as in FIG. 1 the tube end 32 is near to the end of the keg opposite and remote from the wall 10.

Spear tube 30 includes a shoulder 34 and a short portion of the upper end, as illustrated, at 36 is of a larger diameter than the general length of the spear tube. Circlip (RTM) 38 is a free sliding fit on the smaller diameter portion 40 and the spear tube is dimensioned to engage in recess 42 in the head part 44. O ring 46 is to locate in internal groove 38 in the part 44. Poppet valve 50 is of nitrile rubber, EPDM or similar resilient and flexible material in this case moulded about a disc 51 which is of larger diameter than the internal neck 52 in the component 44. The part 44 has a shoulder 47 to contact the insert 56. The shoulder serves to positively retain the spear tube assembly including part 44 in the body at all times, after assembly.

Figure 5:
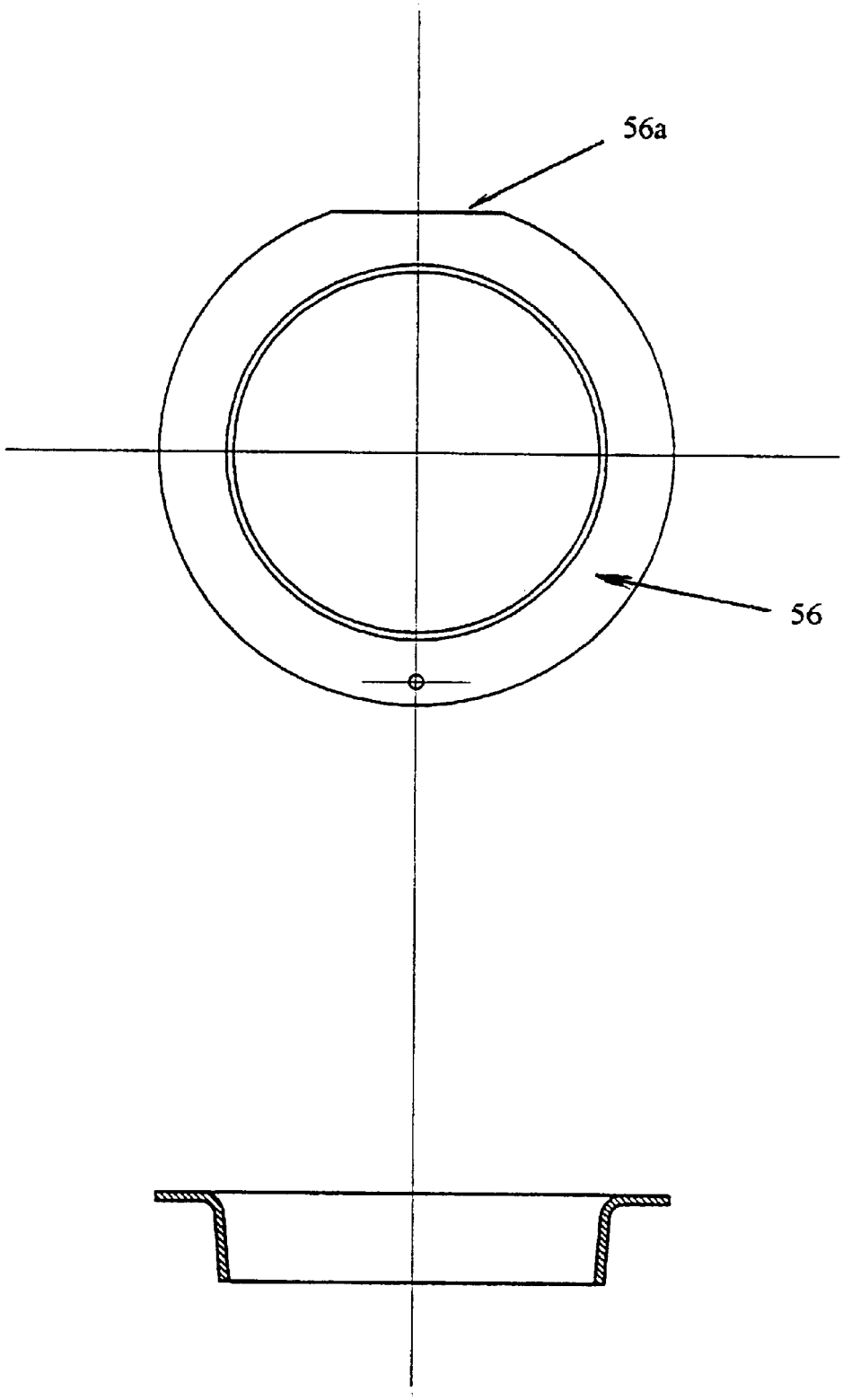
FIG. 5 is a plan view of a component used in the arrangement of FIGS. 1–4.

Annular valve member 54 is a suitable profile to seat in insert 56, this component is also shown in FIG. 5 which illustrates the straight edge 56*a* extending secant-wise of the periphery. This also forms an end abutment for a second coil spring 58. The first coil spring, acting on the poppet valve 50, is indicated by reference numeral 60.

It is now possible to consider assembly. It will be seen that the spear tube 40 can be assembled to the spear head 44 by means of the circlip 38, after first locating the poppet valve 50 in the position illustrated in FIG. 1 together with the poppet valve spring 60. FIG. 1 illustrates a stiffener or reinforcement disc 51 in the poppet valve 50 in the form of an annulus of greater diameter than the neck or throat 52, to the same end.

The assembly may continue with the location of the spring 58 within the cup 22, this being inserted in the direction of the arrow A, FIG. 1. The spear assembly comprising components 30 and 44 with the mentioned assembled parts can likewise be positioned generally, even if not precisely, as illustrated.

Figure 6:
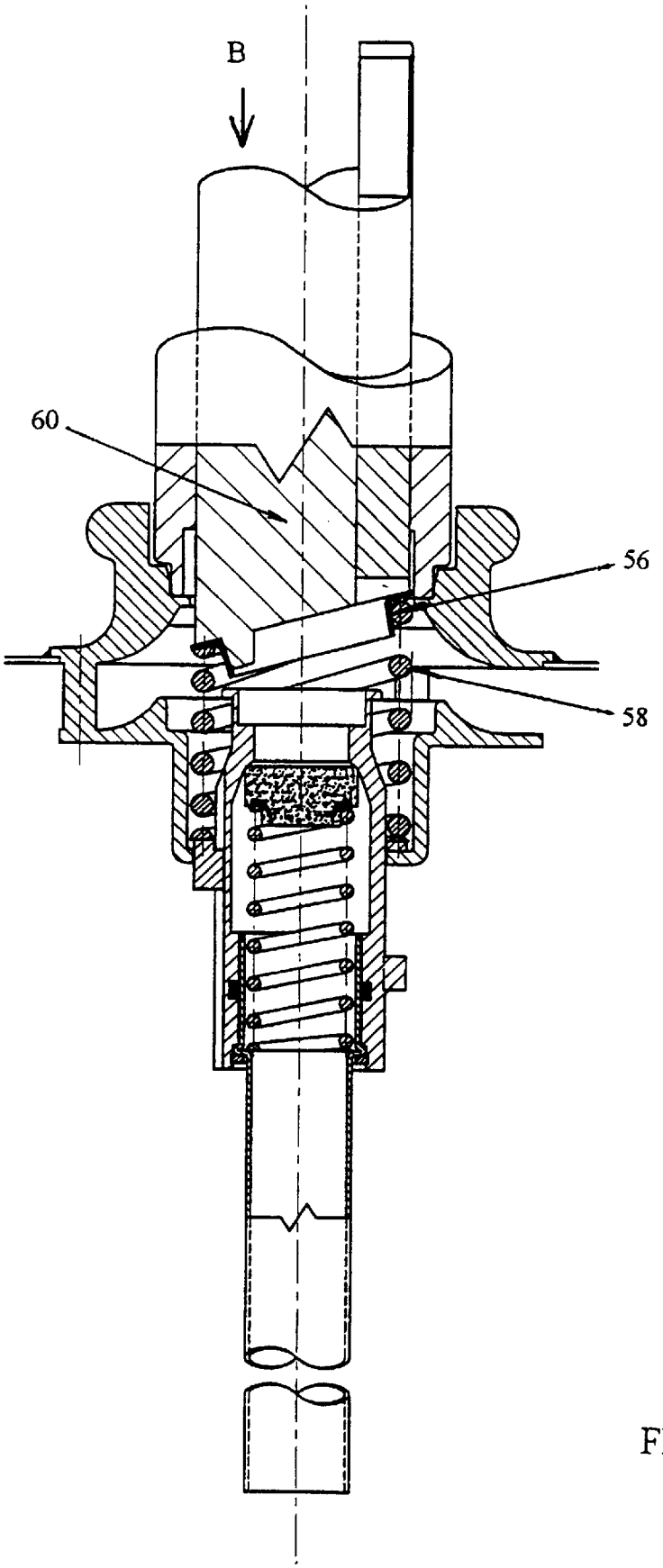
FIGS. 6–10 show consecutive operations of four tools in assembling the spear of the invention.
Figure 7:
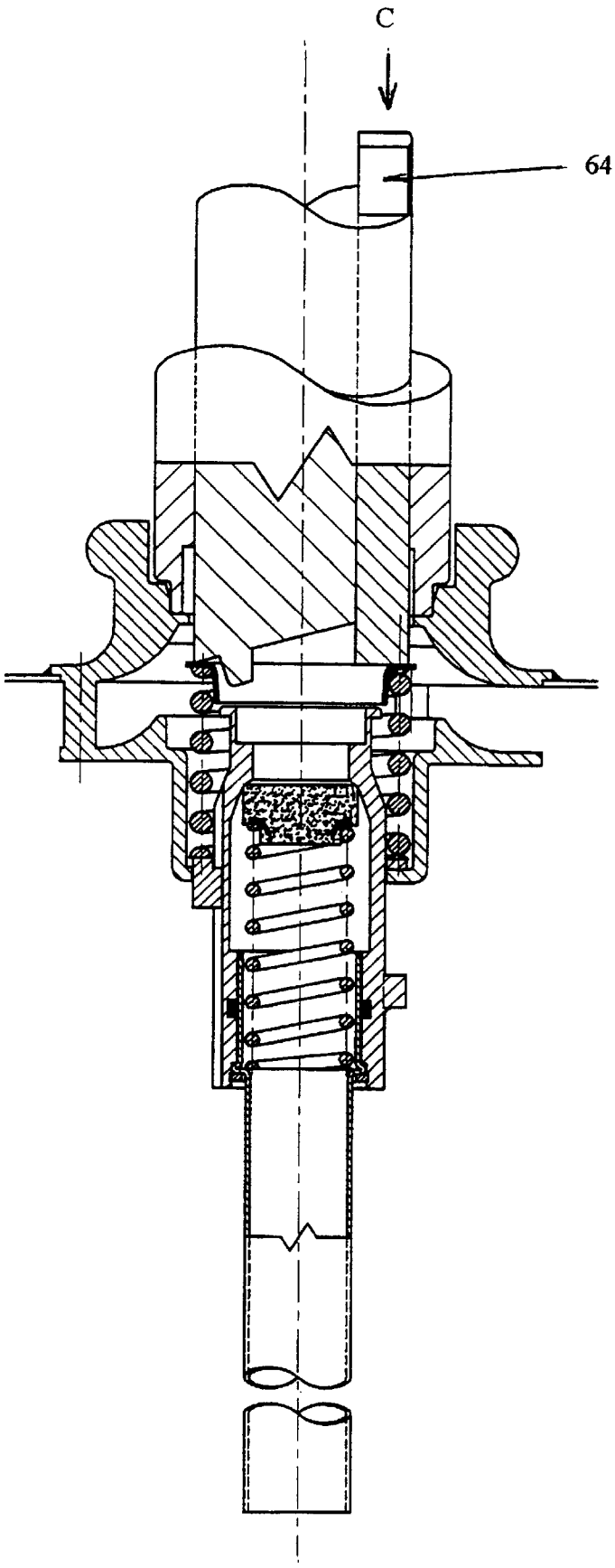

Turning now to FIG. 6, the next step in assembly is illustrated with the insert 56 which forms the support for the annular valve member 54 tilted in a plane out of the normal to the axis of the spear tube and with the secant edge disposed so as to extend along the steepest angle, the insert being supported on a complementary bevelled face of a first forming tool 60. The tool 60 is displaced along the axis in the direction of the arrow B in FIG. 6 (which is the same as the arrow A in FIG. 1) so as to locate the insert 56 on the upper end of the spring 58 and compress the spring as the insert is moved through the throat 62 which is the minimum diameter opening in the upper part of the body 20. When the highest end of the insert is past that aperture, and before the spring binds, the second forming tool 64 (FIG. 7) is displaced in the direction of the arrow C (the same as arrow A and B) to move the insert 56 into a plane normal to the spear axis.

Figure 4:
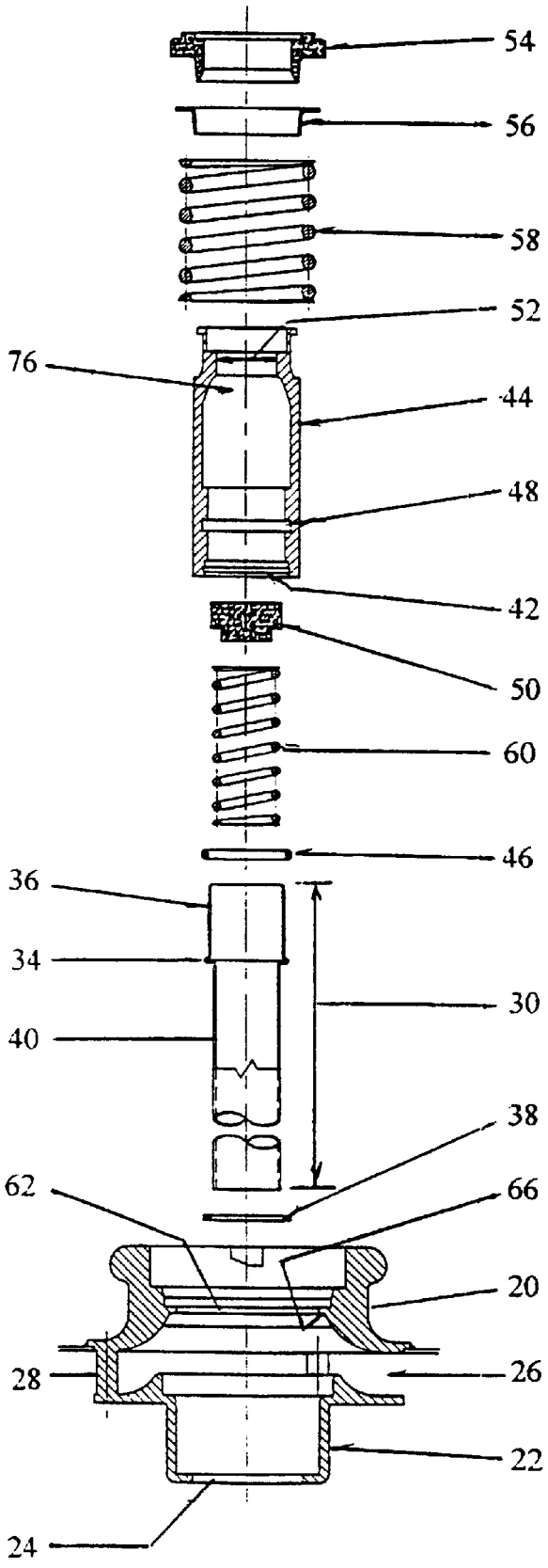
FIG. 4 is an exploded view on a reduced scale showing the parts of the first embodiment.
Figure 8:
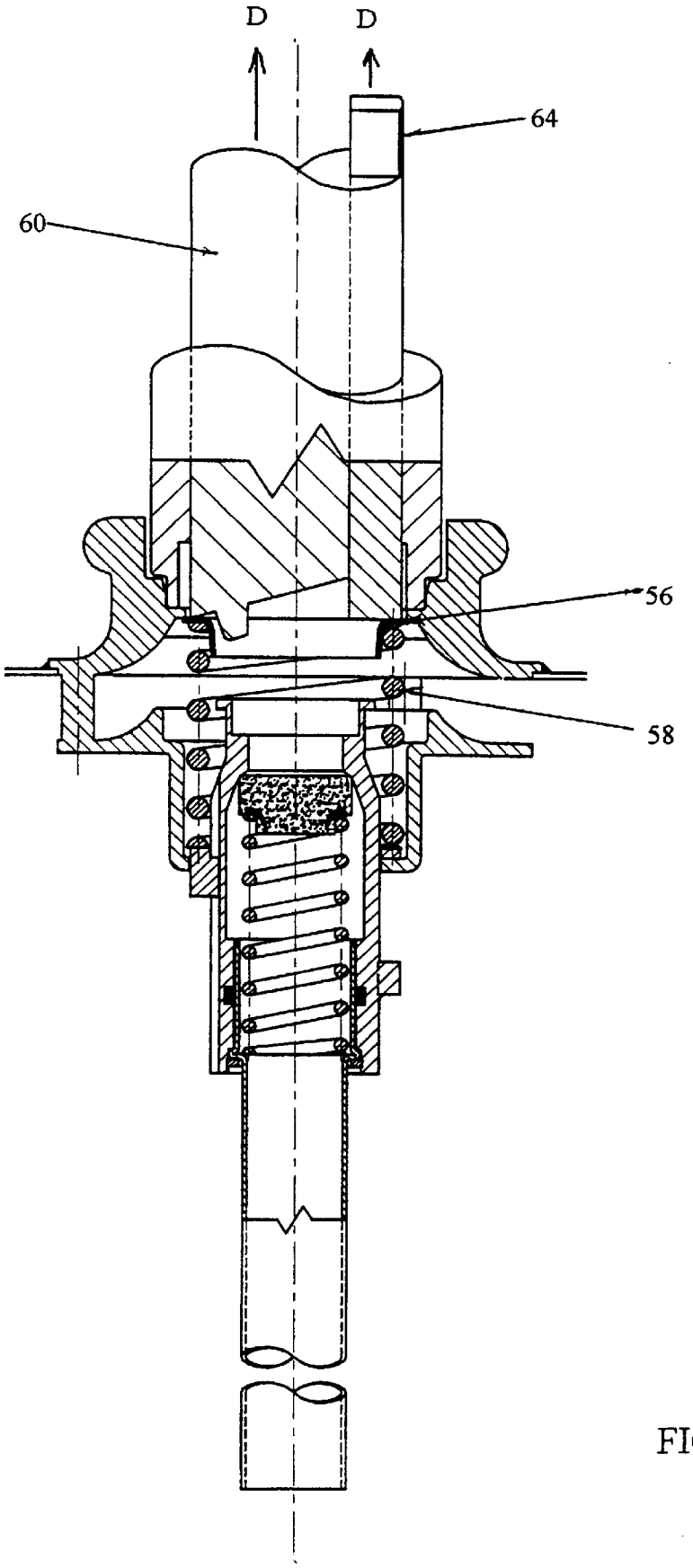

FIG. 8 shows the tools 60, 64 being displaced in the counter direction D to allow the spring 58 to displace the insert 56 when it will abut against the surface 66 immediately below the aperture 62 (FIG. 4). The insert is then trapped in position as it can only pass through the aperture when appropriately inclined (and even then only in a particular angular orientation to the plane of inclination).

Figure 9:
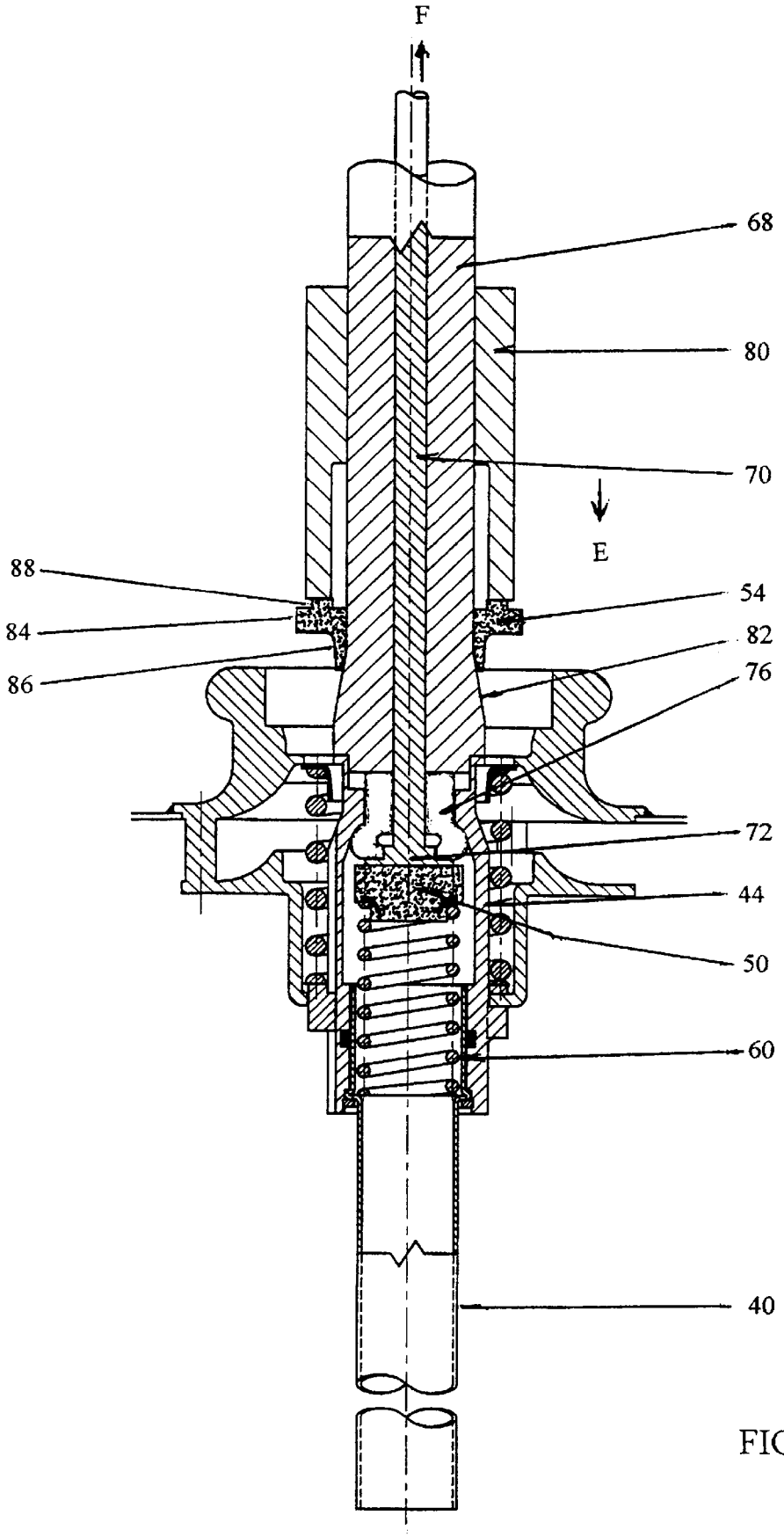

FIG. 9 shows the next stage in assembly when a third tool 68 is moved into the position shown and an inner part 70 is displaced so that a head 72 on that part contacts the poppet valve and in further movement of the part 70 in the direction of the arrow E which is the same as the arrows A, B and C, compresses the spring 60. At this time the lower end of the spear tube 40 may be resting on the bottom of the keg. Surrounding the stem of the part 70 is a generally annular block of rubber or similar compressible and resilient material, illustrated in FIG. 10 with the reference 74, and occupying the space (left empty for clarity, and indicated by the reference 76 in FIG. 9). The retraction of the part 70 by movement in the direction of the arrow F in FIG. 9 whilst the part 68 is held in position, causes the rubber block to deform and swell out radially so as to occupy the poppet valve seat, i.e., the narrowing space 76 located towards the top of the head part 44 (see FIG. 4) and thus fix the part 44 to the tool s 68, 70. This enables those tools to be moved axially in the direction of the arrow F and draw the part 44 from the position shown in FIG. 8 to that shown in FIG. 9, where the upper extremity of the part 44 has been moved from a position below the installed insert 56 in FIG. 8 to a position above that installed insert.

Figure 10:
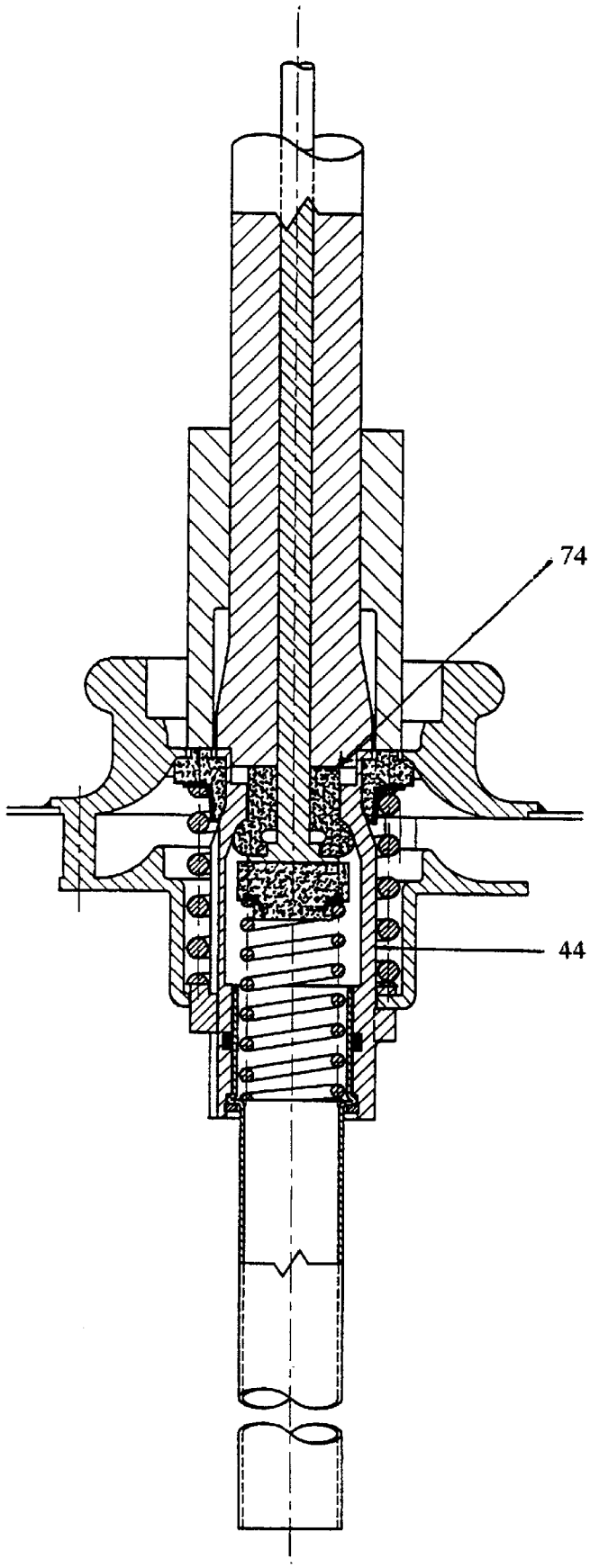
Figure 17:
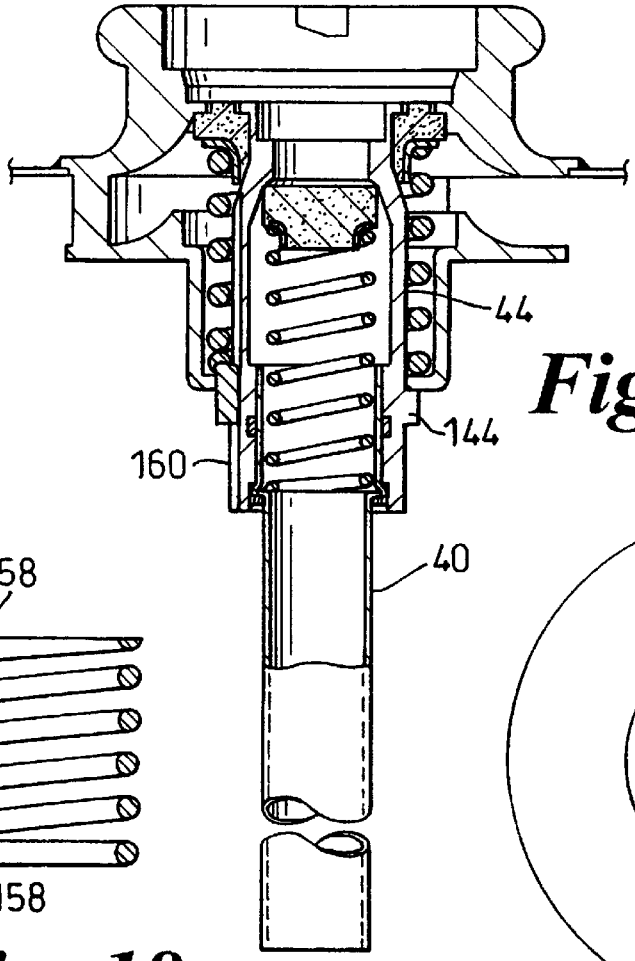
FIG. 17 is a view similar to FIG. 11 but showing a further modification and FIGS. 18–21 are scrap views showing further details of the FIG. 17 arrangement.
Figure 18:
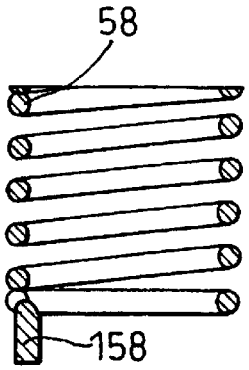
Figure 20:
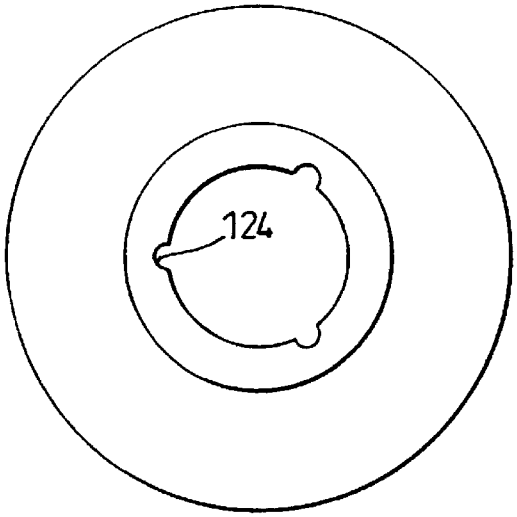
Figure 19:
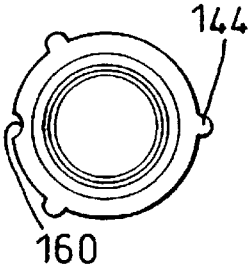
Figure 21:
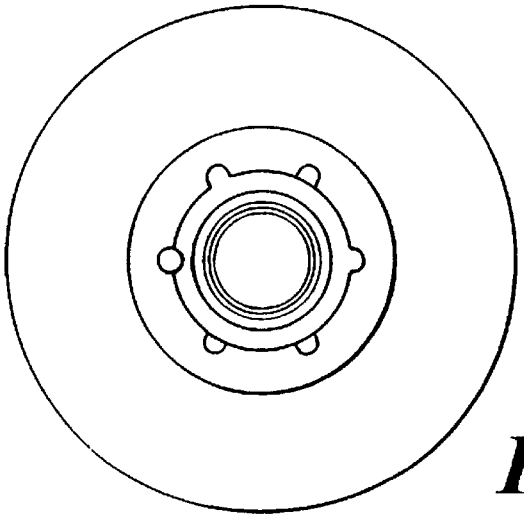

FIG. 10 illustrates the completion of the assembly after the fourth tool part 80 has been displaced in direction of the arrow E in FIG. 9 to take the annular valve washer 54 from the position illustrated in Figure to the position illustrated in FIG. 10 which is the same as that shown in FIG. 1. The resilience and deformability of the washer has been used to enable it to expand over the flared portion 82 of the tool part 68 and snap into its final position. As seen the washer 54 includes a generally planar or radially extending portion 84 with a smaller diameter tubular extension 86 on the lower side and a relatively shallow, larger diameter but axially shorter projection 88 on its upper side. Portion 86 enters the complementary skirt like portion of the insert 56, the portion 84 seats on the radial flange of the insert 56 and the portion 88 lies within the throat or aperture 62 mentioned in the body 20.

It will be seen that after first welding the body to the keg, all of the other assembly operations can be conducted from the exterior. it will also be seen that once so assembled, with the possible exception of use of tools very much as illustrated in FIGS. 7–10, the parts are then permanently assembled. The poppet valve 50 cannot escape through the throat 52 (FIG. 4) because it is of too large diameter and the insert 51 moulded therein prevents deformation to an extent which would make such movement possible. The spear tube itself over the portion 36 is of larger diameter than the throat 52 so that its movement in the direction of arrow F in FIG. 9 is also an impossibility. The shoulder 34 on the spear tube per se also prevents movement of the part 30 relative to the part 44, and the insert 56 positively retains the spring 58 in the body 20 at all times.

The part 44 which is effectively the head of the spear assembly may be larger in diameter than the interior of the insert 76 and hence be held in position against any possible escape by that fact. However additional means for anchoring part 44 or its equivalent in the body 20 or its equivalent are illustrated in connection with the modifications described later herein.

Turning first to FIGS. 11–6 the modified arrangement here is generally similar to that shown in FIG. 1–10 with a number of exceptions as now described.

Firstly, the base of the cup 22 of the body, as shown in FIG. 15, is formed with a number, in this case 3, equispaced radial slots 124. The component 44 is formed with a like number of equispaced lugs 144. By these means, when the spear is mounted within the body, the lugs and slots are aligned so as to enable the lugs to pass from the interior of the cup (above the base) to the illustrated position in FIG. 11 (below the base) and then the component 44 is turned angularly for example by 60 degrees in either direction so as to take the lugs and slots out of alignment and hence retain the part 44 against any possible reverse but solely axial movement in the direction of the arrow G FIG. 11.

In order to retain it in such a position and prevent angular movement which might take the lugs and slots back into alignment, the component 44 has three equispaced axially extending slots 146 and a locking washer FIGS. 12, 13 is employed dimensioned to be a sliding fit on the component 44 with lugs 148 extending radially inwardly to engage in those slots. The lugs also extend axially as shown in FIG. 12. Hence, the washer of FIGS. 12 and 13 may be positioned upon the part 44 before it is inserted through the cup, and after the angular shift which takes the lugs 144 away from the slots 124, the same shift will bring 148 into the same slots. The necessary axial movement to take the lugs 148 through the slots 124 as illustrated in FIG. 11 is followed by seating of the spring 58, before the same is compressed, and when it is loaded it serves to maintain the parts in position.

The embodiment shown in FIGS. 17–21 provides a more alternative and simplified arrangement for the same purposes. In this embodiment the spring 58 is provided with an axially extending tang 158 at its lower end which may engage in an axially extending groove 160 on the outer surface of the part 44 and also through a complementary radial slot in the base of the cup locking the parts together. The same arrangement of lugs 144 and recesses 124 may be provided. Hence the assembly step in this arrangement is to pass the spear tube 40 through the base of the cup, align the lugs 144 on the exterior of the part 44 with the slots 124 until they have passed through the base of the cup, turn the part 44 angularly until the slot 160 is aligned with one of the slots 124, and then assemble the spring so that the tang passes through and locks the part angularly.

In the modification shown in FIG. 22 the poppet valve spring 160 is frustoconical and extends into an annular recess in the poppet valve 150 per se and contacts the margin of the disc like reinforcement 152 therein.

In this case there is also a small modification to the way in which the spear tube 140 is held to the spear head part 44 by crimping lugs or a flange 162 over a radial extension 164 at the end of the spear tube.

Those skilled in the art will recognise the possibility of providing simple and large cross-sectional area flow paths through the assembled spears of the invention, which it is believed offer the possibility of substantially faster filling of kegs, as compared to conventional spears currently in use. This means that if a keg-filling plant has a nominal requirement of a certain number of kegs per working shift, which requires another certain number of filling stations because of the time required for each filling operation, then with use of the spears made according to the present invention, only a smaller number of filling stations will be needed.

What is claimed is:

1. A spear for mounting to a neckless keg opening comprising:

a body adapted to be permanently secured at said keg opening to the neckless keg as by welding said body including a throat defined by an upper part of said body and a valve seat body portion;

a spear tube with an axial flow passage formed in said spear tube, said spear tube movably spring mounted to said body with one spear tube end substantially within said neckless keg and the other spear tube end within said body for communicating flow from within said neckless keg, through said axial flow passage, to said throat;

a first valve, including a spring, mounted within the other spear tube end, for controlling flow through said tube;

a radially outwardly located flow passage in said body communicating flow from the throat to within the neckless keg; and a second valve, mounted between said other spear tube end and said body and within said radially outwardly located flow passage, and cooperating with said valve seat body portion for controlling flow through said radially outwardly located passage;

said second valve including stop means for preventing movement of said spear tube through the throat of said body, when said body is secured to the neckless keg.

2. A spear as claimed in claim 1, wherein said other spear tube end includes a spear head with said axial flow passage defined therein, said spear head having a first valve seat cooperating with said first valve, said first valve formed of a resilient and deformable material enveloping completely a relatively rigid reinforcement annulus which is of greater dimension than said first valve seat to prevent said first valve from being spring driven through said first valve seat.

3. A spear as claimed in claim 2, wherein said spear head includes a shoulder portion, and said stop means includes an insert with a lower insert portion engageably contacting said shoulder portion and an upper insert portion adapted to support said second valve.

4. A spear as claimed in claim 1, including a clip mounting said spear tube to said spear head.

5. A spear as claimed in claim 1, wherein said spear tube is fixed to said spear head by crimping.

6. A spear as claimed in claim 2, wherein said body includes a lower cup portion having a base with a central aperture adapted to receive said spear head, said base at said aperture and said spear head having respective radial slots and radial lugs which when registered enable movement of the spear head to an assembled position from a position external to the keg, and after a relative angular movement prevent withdrawal therefrom and hence prevent pressurized ejection therefrom.

7. A spear as claimed in claim 6, wherein said spear head further includes an axially extending groove aligned with said central aperture, and a second spring surrounding said spear head and intermediate said base and said second valve, said second spring having a tail tang extending in said groove and in a matching radial recess in said base so as to angularly lock said spear.

8. A spear as claimed in claim 3, said insert being of larger diameter than said valve seat body portion over a major portion of its periphery and having a second edge to provide a dimension diametric of the insert at one point which is smaller than the comparable dimension of said valve seat body portion to enable said insert to pass from one side of said seat to the other when cocked at an angle to its eventual plane of location.

* * * * *

UNITED STATES PATENT AND TRADEMARK OFFICE

CERTIFICATE OF CORRECTION

PATENT NO. : 6,308,869 B1
DATED : October 30, 2001
INVENTOR(S) : Kenneth Leonard Simpson It is certified that error appears in the above-identified patent and that said Letters Patent is hereby corrected as shown below:

Column 5, claim 1,
Line 18, please insert a comma between "welding" and "said".

Signed and Sealed this

Ninth Day of April, 2002

*Attest:*

*Attesting Officer*

JAMES E. ROGAN
*Director of the United States Patent and Trademark Office*